US007892147B2

(12) United States Patent
Vick, Jr.

(10) Patent No.: US 7,892,147 B2
(45) Date of Patent: Feb. 22, 2011

(54) ABDOMINAL EXERCISE DEVICE WITH ALARM

(76) Inventor: Richard N. Vick, Jr., 103 Shaftsbury Rd., Ahoski, NC (US) 27910

( * ) Notice: Subject to any disclaimer, the term of this patent is extended or adjusted under 35 U.S.C. 154(b) by 58 days.

(21) Appl. No.: 12/229,732

(22) Filed: Aug. 26, 2008

(65) Prior Publication Data

US 2009/0062074 A1 Mar. 5, 2009

Related U.S. Application Data

(60) Provisional application No. 60/967,157, filed on Aug. 31, 2007.

(51) Int. Cl.
*A63B 71/00* (2006.01)
*A63B 26/00* (2006.01)
*G08B 23/00* (2006.01)

(52) U.S. Cl. ..... 482/8; 482/142; 482/909; 340/573.1

(58) Field of Classification Search ..... 482/8, 482/92, 121, 123, 129, 130, 133, 140, 142, 482/1, 145, 909; 33/511, 512; 600/587, 600/594, 595; 73/865.4; 340/573.1, 573.7
See application file for complete search history.

(56) References Cited

U.S. PATENT DOCUMENTS 5,113,176 A 5/1992 Harris
5,486,150 A 1/1996 Randolph
5,616,111 A 4/1997 Randolph
6,132,347 A * 10/2000 Alessandri ..... 482/134
6,168,557 B1 * 1/2001 Liao ..... 482/140
6,186,926 B1 * 2/2001 Ellis ..... 482/97
6,258,016 B1 * 7/2001 Kuo ..... 482/142
6,776,743 B2 * 8/2004 Hur ..... 482/140
6,855,098 B2 * 2/2005 Reitz et al. ..... 482/142
6,896,643 B2 * 5/2005 Durfee, Jr. ..... 482/100
7,115,081 B2 * 10/2006 Stearns ..... 482/140
7,252,626 B2 * 8/2007 Hur ..... 482/91
7,481,752 B2 * 1/2009 Garner ..... 482/140
2002/0111257 A1 * 8/2002 Hur ..... 482/140
2003/0171194 A1 * 9/2003 Chung ..... 482/123
2003/0176263 A1 * 9/2003 Parmater ..... 482/140
2003/0199372 A1 * 10/2003 Robinson et al. ..... 482/140
2004/0152572 A1 * 8/2004 Reitz et al. ..... 482/140
2004/0259703 A1 * 12/2004 Goh ..... 482/140
2005/0272581 A1 * 12/2005 Stearns ..... 482/140
2006/0166799 A1 * 7/2006 Boland et al. ..... 482/140
2007/0259760 A1 * 11/2007 Perez ..... 482/140
2007/0287619 A1 * 12/2007 Tuller ..... 482/140

* cited by examiner

*Primary Examiner*—Loan Thanh
*Assistant Examiner*—Sundhara M Ganesan
(74) *Attorney, Agent, or Firm*—Maccord Mason PLLC

(57) ABSTRACT

An abdominal exercise device is described that includes an alarm means to promote proper user positioning for abdominal muscle isolation. The exercise device includes a frame; a seat carried on the frame; a backrest attached to the frame, the backrest including a mounting plate and a backrest pad pivotally attached to the mounting plate; a user perceivable alarm; a first sensor associated with the backrest to sense the pressure exerted by the user on the backrest, the first sensor activating the alarm when the pressure is outside a preset range; and, optionally, a second sensor associated with the backrest to sense the angle of the backrest pad, the second sensor activating the alarm when the angle is outside a preset range.

19 Claims, 2 Drawing Sheets

ABDOMINAL EXERCISE DEVICE WITH ALARM

This application claims the benefit of U.S. Provisional Application Ser. No. 60/967,157, filed Aug. 31, 2007, which is incorporated herein in its entirety.

BACKGROUND OF THE INVENTION (1) Field of the Invention

The present invention relates generally to a device for use in exercising and strengthening the abdominal muscles, and in particular to an abdominal exercise device that includes an alarm that is activated when the pressure or angle of the user's body against a backrest is outside a preset range, thereby promoting proper user posture to isolate the abdominal muscles.

(2) Description of the Prior Art

Historically, the exercises used to strengthen the abdominal muscles are sit-ups and crunches. However, these exercises do not adequately isolate the abdominal muscles from other muscles. As a result, the benefits of the exercises are lessened and may in fact be detrimental.

The prior art discloses numerous abdominal exercise devices that purport to isolate the abdominal muscles from other muscles to enhance the value of the exercise. However, while supporting the user in various ways, none of these prior art devices inform the user when the user is incorrectly positioned. Therefore, there is still a need for an exercise device for use in abdominal exercises that will isolate the abdominal muscles both by positioning the user and by alerting the user of the need to adjust his/her position during the exercise.

SUMMARY OF THE INVENTION

Generally, the present invention addresses this need with an abdominal exercise device in which the user exercises his/her abdominal muscles from a seated position, with an alarm means ensuring that the user maintains correct back posture and thereby proper abdominal muscle isolation as the abdominal muscles are exercised by arm and/or leg exertion. In particular, the device includes a backrest that is positioned so the user's back is pressed against the backrest during exercise. The backrest includes a sensor, normally a pressure switch that activates an alarm, e.g., a buzzer or other sound emitter, when the user's pressure against the backrest is above or below a predetermined range. The backrest can also include a sensor to activate an alarm when the user's posture is incorrect by sensing the angle of a part of the backrest.

The exercise device of the present invention is comprised of a frame to support the other elements of the device; a seat mounted on the frame; leg supports pivotally attached to the frame; an arm support attached to the frame; and a backrest that includes one or more sensors, and an alarm operatively associated with the sensors.

More specifically, the exercise device frame, which is preferably of square tubular steel or other material adequate to support the user during exercise, includes a horizontal base, left and right parallel vertical leg support posts, left and right horizontal seat supports extending rearwardly from the leg support posts to inner ends, a longitudinally extendible upright brace extending upwardly to an upper end, an upper crossbar with opposed outer ends attached to the upper end of the upright brace, and left and right rearwardly inclined support members extending from the inner ends of the horizontal seat supports to the upper crossbar. A lower horizontal crossbar also extends between the support posts.

A seat is mounted on the lower horizontal crossbar. Preferably, the seat tilts rearwardly, e.g., about 10° to urge the user to lean backward during the exercise. An adjustable sacral support or seat back is mounted behind and slightly above the level of the seat to determine the user's position on the seat. The sacral support is mounted on a third horizontal crossbar that extends between the inclined support members.

Left and right leg supports with inner and outer ends are pivotally attached to the upper ends of the left and right support posts, respectively, at pivot points located intermediate the inner and outer ends. Preferably, the leg supports are longitudinally adjustable to accommodate users of different physical dimensions. Foot restraints are located at the outer ends of the leg supports to provide rests for the user's heels so that the user can pivot the outer ends of the leg supports downward. Resilient member, e.g., bungee cords, extend from the inner ends of the leg supports to the frame base. The lengths of the resilient members are such that the leg supports are held in a generally horizontal position when no leg force is being exerted.

A lateral bar with opposed outer ends is attached to the left and right inclined support members at approximately the user's shoulder level and includes arm resistant exercise means that includes handgrips positioned at the outer ends of the lateral bars where they are graspable by the user, who can pull the grips downward or forward during exercise. The handgrips are attached to resilient members to urge the handgrips to their unextended positions when not being pulled by the user. For example, the handgrips can be attached to cords having resilient components with the cords extending around pulleys. The resistance of the handgrips may be changed by changing the tension on the cords, or varied, e.g., by using a pulley having a non-circular wheel.

A fourth horizontal crossbar for use in mounting the backrest extends between the inclined support members below the lateral bar and above the sacral support. This crossbar, and thereby the vertical level of the backrest relative to the seat, is adjustable along the inclined support members to accommodate users of different physical dimensions. The backrest is comprised of a mounting plate for attachment to the crossbar, and a pad to engage the user's back. The pad may be hinged to the mounting plate so that the pad pivots, changing the orientation of the pad and the position of the upper end of the pad relative to the lower end of the pad.

One or more sensors are associated with the backrest to alert the user when too little or too much pressure is being exerted by the user against the backrest and/or when the orientation of the backrest is changed due to the user's incorrect posture. The sensor may be of various configurations which will be obvious to one skilled in the art. For example, the sensors may be adjustable pressure sensitive sensors or switches that are closed (or opened depending on the circuit construction) when the pressure against the backrest or angle of the backrest is outside of a preset range. The sensors will, in turn, be in a circuit with a user perceivable device, such as a sound or light emitter that will be activated when out-of-range pressure or out-of-posture orientation is applied to the backrest.

While the invention is described herein in the context of particular exercises and posture relating to the back orientation of the user, it will be understood that the apparatus and backpad is also useful with other exercises and in the monitoring of the position of other parts of the body, e.g., the user's shoulders.

In operation, the user sits on the seat, placing his/her heels on the heel rests, and reclines against the sacral support and the backrest, which is then activated. The leg supports are extended longitudinally so that the angle of the user's upper and lower legs are at an angle of 90°. The user's torso is at an angle of 70° relative to the user's upper leg.

The user can then use his/her legs with the heels in the heel cups to exert a downward force on the leg supports. The user's arms can also be used to exercise the torso by pulling on the handgrips attached to the lateral bar.

As the user exercises in the above manner, there is a tendency for the user to lean forward or push backward, bringing into play other muscles and lessening the impact of the exercise on the abdominal muscles. However, with the present invention, when the user leans forward or pushes backward greater than a preset value, the change in the user's position will be detected by the pressure sensor, which will active an alarm to remind the user to resume his/her correct posture. The sensitivity of the alarm can be adjusted by extending the acceptable range.

In addition, while the user may apply pressure against the backrest that is within the preset range, the user may use incorrect posture. For example, the user may lean forward, curving his or her back so that a disproportionate pressure is applied against the lower part of the backrest. To detect this incorrect posture, the backrest may be pivotal and include another alarm-associated sensor to sense the orientation of a part of the backrest.

The abdominals are isolated with this device by providing isolated resistance to the hip extensors which causes an inhibition of the hip flexors which are the prime substitutors of the abdominals. Hip extension is accomplished via adjustability of the leg attachment so that the knee can be flexed and fixed at 95° to 100°. The ankle is immobile with the force being borne through the heel as the legs move downward.

Further isolation aspects are due to the trunk being maintained in an upright position via the feedback mechanism, and the various placements of the arms in exercise, e.g., the arms overhead or out to the side help eliminate the pectoral muscles from assisting. The tension required of the abdominals can be changed by increasing the tension of the leg bands or arm bands, adjusting the tension of the back pad spring, reclining the device such that the patient has to account for more of their body weight, and by the various positions of the arms in exercise.

DETAILED DESCRIPTION OF THE INVENTION

Figure 1:
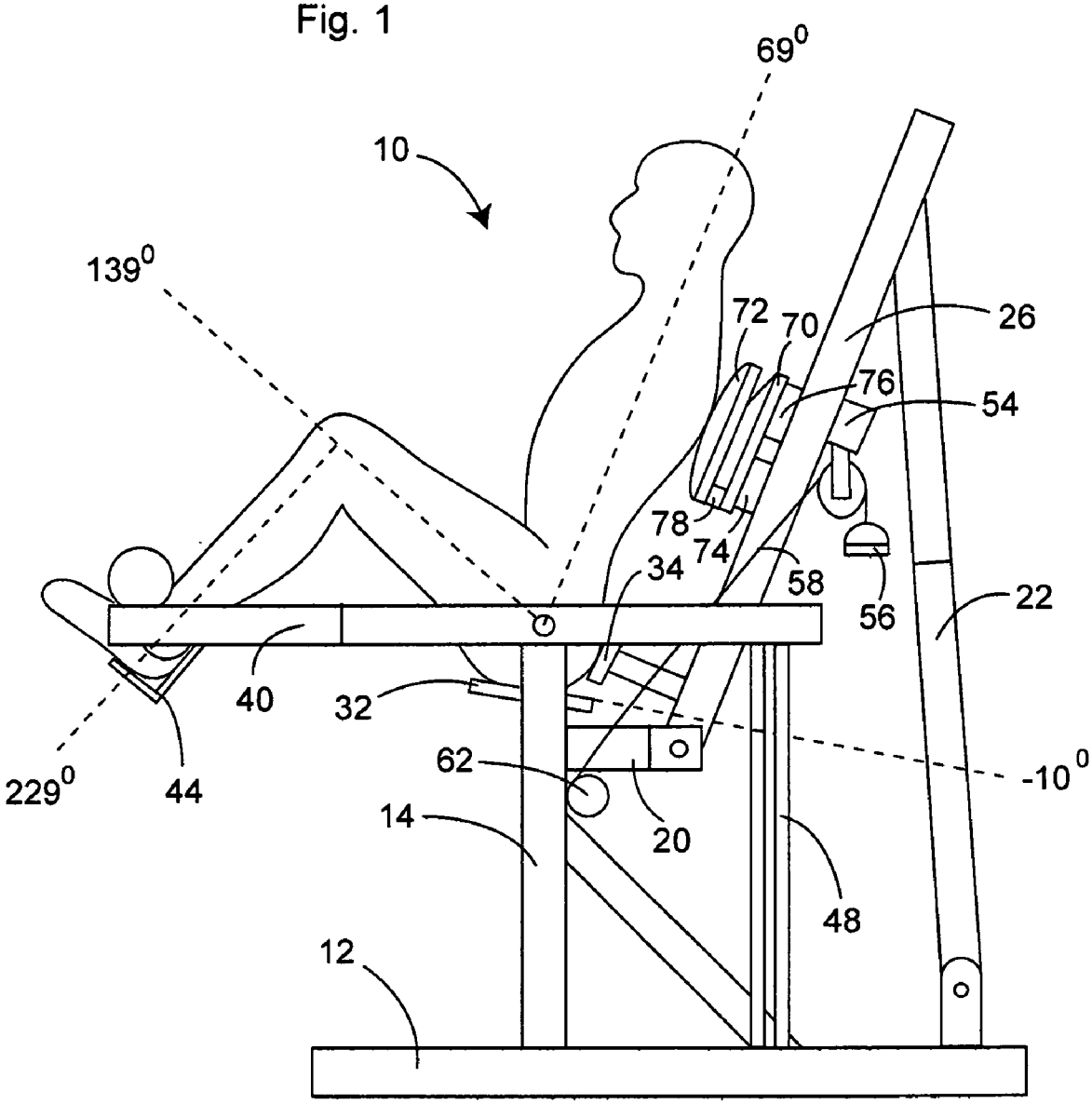
FIG. 1 is a side view of the exercise device.
Figure 2:
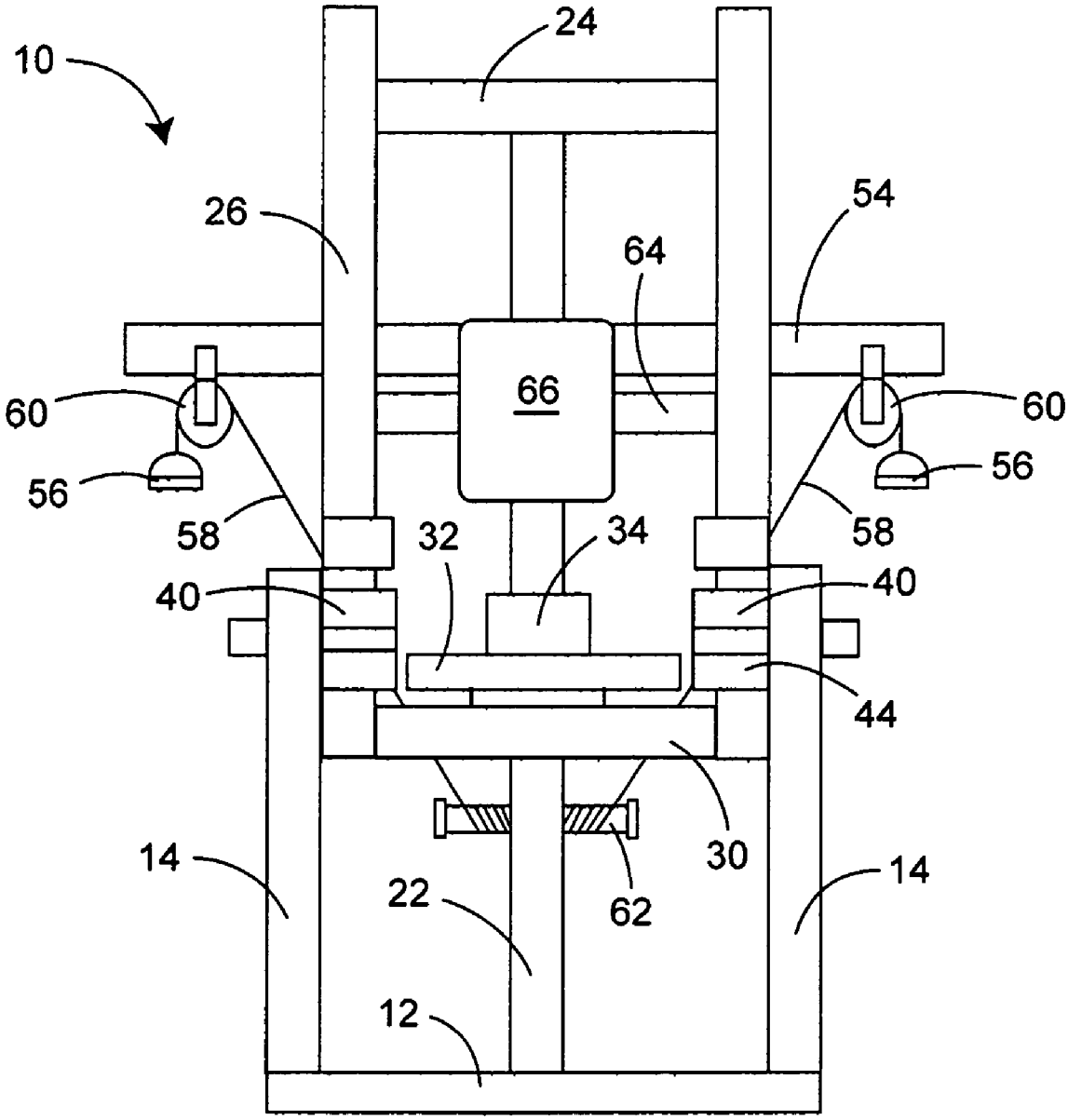
FIG. 2 is a front view of the exercise device.

In the following description of a preferred embodiment of the invention, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As shown in the drawings, exercise device, generally 10, is comprised of a frame having a horizontal base 12, left and right parallel vertical leg support posts 14, left and right horizontal connectors 18 extending rearwardly from the leg support posts 14, an upright brace 22 extending upwardly to an upper end, an upper crossbar 24 with opposed outer ends attached to the upper end of upright brace 22, and left and right rearwardly inclined support members 26 extending upwardly from the inner ends of the connectors 18 to upper crossbar 24.

Lower horizontal crossbar 30 extends between support posts 14. Seat 32 is mounted on crossbar 30. An adjustable sacral support 34 is mounted on a third horizontal crossbar 36 that extends between inclined support members 26.

Longitudinally extendible left and right leg supports 40 having inner and outer ends are pivotally attached to the upper ends of left and right support posts 14 at pivot points located intermediate the inner and outer ends. Foot restraints 44 are located at the outer ends of leg supports 40, while bungee cords or other resilient members 48, extend from the inner ends of leg supports 40 to frame base 12. The lengths of resilient members 48 are such that leg supports 40 are held in a generally horizontal position when no leg force is being exerted.

Device 10 also includes lateral bar 54 with opposed outer ends attached to left and right inclined support members 26 at approximately the user's shoulder level. An arm resistant exercise means is carried on bar 54 and includes handgrips 56 attached to cords 58 that extend around pulleys 60. The opposite ends of cords 58 are attached to a rotatable spool 62. Cords 58, or a part thereof, are preferably elastic, so that the tension on cords 58, and thereby the force required to pull handgrips 56 downward or outward can be changed by rotation of spool 62. Pulleys 60 may have an oval cross-section so that the force exerted by the user varies as the handgrips are pulled.

A fourth horizontal crossbar 64 extends between the inclined support members 26 below lateral bar 54 and above sacral support 34 for use in mounting backrest 66. Crossbar 58, and thereby the height of backrest 66, is adjustable along inclined support members 26 to accommodate users of different physical dimensions.

Backrest 66 is comprised of mounting plate 70 and pad 72 to engage the user's back. Pad 72 is pivotally hinged to plate 70 so that pad 72 will tilt forward and back. When tilted forward, the upper edge of pad 72 moves toward the user, while the lower edge of pad 72 moves away from the user. A first sensor 74, which may be a pressure sensitive switch, is operatively associated with backrest 66 to alert the user when too little or too much pressure is exerted by the user against backrest 66, i.e., when the pressure exerted against pad 72 is outside of a given preset range. Sensor 74 is operatively connected to alarm 76, e.g., a sound emitter. During exercise, no alarm sounds so long as the user exerts the correct amount of pressure by resting his or her back on backrest 66. However, if the user exerts too much pressure, or too little pressure, the out-of-range pressure will be detected by sensor 74, which will activate alarm 76.

A second sensor 78 is operatively associated with backrest 66 to alert the user when the user's posture is incorrect, e.g., when the user is leaning too far forward. Sensor 78 is also connected to an alarm, which is represented by alarm 76, although it will be understood that the sensors may be connected to separate alarms. Sensor 78 can be independent of sensor 74 and will active alarm 76 when the user tilts his or her body too far forward or backward, causing tilting of backrest 66, even if the pressure against backrest 66 is within the preset acceptable range.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An abdominal exercise device with alarm means to promote proper user positioning for abdominal muscle isolation comprising:

a) a frame;

b) a seat carried on said frame;

c) downwardly pivotal leg supports attached to said frame;

d) a backrest attached to said frame, said backrest being adjustable relative to said seat and including a mounting plate with a pad to engage the user's back hinged to said mounting plate, said pad being pivotal to change the orientation of the pad and the position of the upper end of the pad relative to the lower end of the pad; and e) an alarm activated when the user changes position so that the pressure exerted by the user on said backrest pad or the angle of said backrest pad is above or below a preset range.

2. The exercise device of claim 1, further including a sensor associated with said backrest pad and said alarm to determine when the pressure on said backrest pad or the angle of said pad is above or below a preset range and to activate said alarm.

3. The exercise device of claim 1, further including arm resistance exercise means.

4. The exercise device of claim 1, wherein said alarm is an audible alarm.

5. The exercise device of claim 1, further including a sacral support.

6. The exercise device of claim 1, wherein said leg support is generally horizontal when in an unstressed position.

7. The exercise device of claim 1, wherein said leg supports include foot restraints at their distal ends.

8. The exercise device of claim 1, wherein said leg supports are longitudinally adjustable.

9. The exercise device of claim 1, wherein said frame includes a rearwardly inclined frame member to support said backrest, said back support being vertically adjustable on said frame member.

10. The exercise device of claim 1, further including resilient restraining member to urge said leg supports to their unstressed position.

11. The exercise device of claim 1, further including a horizontal bar with opposed outer ends and arm resistant exercise members adjacent the outer ends of said bar.

12. The exercise device of claim 1, wherein said backrest includes a sensor activated audible alarm.

13. An abdominal exercise device with alarm means to promote proper user positioning for abdominal muscle isolation comprising:

a) a frame;

b) a seat carried on said frame;

c) a backrest attached to said frame, said backrest being adjustable relative to said seat and including a mounting plate and a backrest pad pivotally attached to said mounting plate, said pad being pivotal to change the orientation of the pad and the position of the upper end of the pad relative to the lower end of the pad;

d) a user perceivable alarm;

e) a first sensor associated with said backrest to sense the pressure exerted by the user on said backrest pad, said first sensor activating said alarm when the user changes position so that said pressure is above or below a preset range;

f) a second sensor associated with said backrest to sense the angle of said backrest pad, said second sensor activating said alarm when the user changes position so that said angle is above or below a preset range; and g) downwardly pivotal leg supports attached to said frame, said leg supports being generally horizontal when in an unstressed position.

14. The exercise device of claim 13, further including a horizontal bar with opposed outer ends and arm resistant exercise members adjacent the outer ends of said bar, said arm resistant exercise members including handgrips attached to elastic cords extending over pulleys having an oval cross-section.

15. The exercise device of claim 13, further including a sacral support.

16. The exercise device of claim 13, wherein said leg supports include foot restraints at their distal ends.

17. The exercise device of claim 13, wherein said leg supports are longitudinally adjustable.

18. The exercise device of claim 13, wherein said frame includes a rearwardly inclined frame member to support said backrest, said back support being vertically adjustable on said frame member.

19. The exercise device of claim 13, further including resilient restraining member to urge said leg supports to their unstressed position.

* * * * *